US006131593A

United States Patent [19]

Greene et al.

[11] Patent Number: 6,131,593

[45] Date of Patent: Oct. 17, 2000

[54] TIP FOR A CANE OR THE LIKE

[76] Inventors: Arthur Greene, 217 Sundance Rd., Stamford, Conn. 06905; Leonard Berlin, 9 Northwood Ct., Dix Hills, N.Y. 11746

[21] Appl. No.: 09/138,248

[22] Filed: Aug. 21, 1998

Related U.S. Application Data

[63] Continuation-in-part of application No. 09/009,024, Jan. 20, 1998, Pat. No. 5,992,434.

[51] Int. Cl.[7] ..... A45B 9/04

[52] U.S. Cl. ..... 135/77

[58] Field of Search ..... 135/65–68, 77–86

[56] References Cited

U.S. PATENT DOCUMENTS

| | | | |
|---|---|---|---|
| D. 378,551 | 3/1997 | Shelnutt | D3/17 |
| 2,910,995 | 11/1959 | Jacuzzi | 135/62 |
| 3,040,757 | 6/1962 | Smith | 135/64 |
| 3,163,437 | 12/1964 | Phillipson | 135/77 |
| 3,251,372 | 5/1966 | Smith | 135/64 |
| 3,731,920 | 5/1973 | Matsuda | 272/57 E |
| 3,741,226 | 6/1973 | Urban | 135/62 |
| 4,098,283 | 7/1978 | Tritle | 135/77 |
| 4,135,536 | 1/1979 | Willis | 135/84 |
| 4,141,375 | 2/1979 | Tykwinski | 135/66 |
| 4,562,851 | 1/1986 | Frank | 135/78 |
| 4,601,302 | 7/1986 | Breen et al. | 135/66 |
| 4,630,626 | 12/1986 | Urban | 135/84 |
| 4,881,564 | 11/1989 | Fetterman | 135/82 |
| 4,899,771 | 2/1990 | Wilkinson | 135/77 |
| 5,178,176 | 1/1993 | Fetterman | 135/86 |
| 5,238,013 | 8/1993 | Battiston et al. | 135/75 |
| 5,301,704 | 4/1994 | Brown | 135/78 |
| 5,307,828 | 5/1994 | Gardner et al. | 135/82 |
| 5,331,989 | 7/1994 | Stephens | 135/65 |
| 5,392,801 | 2/1995 | Hannoosh | 135/65 |
| 5,409,029 | 4/1995 | Davis | 135/68 |
| 5,713,382 | 2/1998 | Midcap | 135/84 |
| 5,727,584 | 3/1998 | Stanec | 135/77 |
| 5,826,606 | 10/1998 | Davenport | 135/82 |
| 5,829,463 | 11/1998 | Galan | 135/77 |

OTHER PUBLICATIONS

Product Report on Canes, by AARP, 15 pages, Nov. 1992.

PM Tech Update Archive, "Cane is designed to Stand by Itself", Aug. 1996.

*Primary Examiner*—Beth A. Stephan

*Attorney, Agent, or Firm*—David P. Gordon; David S. Jacobson; Thomas A. Gallagher

[57] ABSTRACT

A cane tip has a body having an upper portion and a lower portion provided with a preferably concave traction surface. The lower portion tapers toward the upper portion and includes three preferably narrow, substantially planar regions sloping down toward the traction surface interposed by three preferably arcuate, web-like regions which together form a generally compact triangular footprint having truncated corners and arcuate sides. The body includes a bore which enters through the upper portion of the body and terminates above the traction surface and which receives and holds the lower end of the cane. The bore preferably includes a plurality of circumferential ribs which assist in securing the end of the cane. The traction surface preferably includes a circular central region and a plurality of structural branches radiating from the central region. A reinforcing plate is preferably provided in the body between the bore and the traction surface to prevent the end of the cane from inadvertently rupturing the traction surface. A sleeve is also preferably provided for use between the end of the cane and the bore in the body to accommodate cane ends of varying sizes. The cane tip permits a cane provided therein to be self-standing.

34 Claims, 4 Drawing Sheets

TIP FOR A CANE OR THE LIKE

This application is a continuation-in-part of U.S. Ser. No. 09/009,024, filed Jan. 20, 1998, U.S. Pat. No. 5,992,434 which is hereby incorporated by reference herein in its entirety.

BACKGROUND OF THE INVENTION

1. Field of the Invention

This invention relates broadly to tips for canes and the like. More particularly, this invention relates to such tips which provide greater stability to the cane or the like.

2. State of the Art

Canes are often used by the elderly and other individuals who need support while walking or standing. However, the tip typically provided on a cane is not particularly stable and may not provide sufficient traction when walking on slippery surfaces. When an individual is not using his or her cane, the cane is typically oriented in a leaning position where the individual can reach it when so desired. However, leaning canes often fall over, creating great difficulty for the individual to reach and then pick up the cane for use.

Though not widely used, canes and aftermarket cane tips are known which provide additional cane stability or traction for certain uses. For example, U.S. Pat. No. 5,301,704 to Brown provides a cane for use on slippery and icy surfaces. The cane has a tip which has a convex arcuate lower surface, and one or more rows of spikes extending downward from the lower surface. The arcuate surface permits the cane to be rocked through a stride and the spikes provide gripping in any icy surface. However, a spiked cane is not ideal for everyday use. Furthermore, the arcuate surface does not provide the necessary stability that many elderly require when standing still or walking. In addition, the arcuate surface of the tip may make the cane prone to falling over from where the cane was placed for later retrieval.

U.S. Pat. No. 4,881,564 to Fetterman discloses a crutch tip having a tubular portion for receiving the end of a crutch, an absorption pad beneath the tubular portion, and a tread piece beneath the absorption pad. The tread piece includes depending portions for receiving and flexing about small obstacles (e.g., pebbles) on the ground while maintaining traction with the ground. The tip is constructed to be highly flexible (the upper portion of the tip may be bent at an angle of 50° relative to the lower portion of the tread piece). While this flexibility may provide certain advantage with respect to traction of the of tip; i.e., the ability for the tip to remain gripped the ground even as the crutch is tilted, it will be appreciated that such a tip provides too much instability for a cane used by the elderly who require a stiffer, more stable tip having satisfactory traction.

A common solution for those who require a more stable cane is the use of a multipod cane. A multipod cane has a branched end provided with a plurality of cane tips, e.g., four tips. The multipod cane is self-standing and therefore alleviates the 'falling cane' problem. However, the cane has a large footprint and may interfere with the stride of the individual using the cane, or worse, trip the individual. This problem is amplified when the bulky multipod cane is used on stairs. Moreover, the cane be quite unstable if all of the tips do not rest on a planar surface.

SUMMARY OF THE INVENTION

It is therefore an object of the invention to provide a cane tip which permits a cane provided therein to be self-standing.

It is another object of the invention to provide a cane tip which has a relatively small footprint.

It is a further object of the invention to provide a cane tip which is stable.

It is an additional object of the invention to provide a cane tip which has excellent traction.

It is also an object of the invention to provide a cane tip which is easily retrofit on existing canes.

It is still another object of the invention to provide a self-standing cane having a single cane tip.

In accord with these objects, which will be discussed in detail below, a cane is provided with a tip which has a body having an upper portion and a lower portion provided with a preferably concave traction surface. The lower portion preferably tapers toward the upper portion. The body includes a bore which enters through the upper portion of the body and terminates above the traction surface and which receives and holds the lower end of the cane. The bore preferably includes a plurality of circumferential ribs which assist in securing the end of the cane.

According to a preferred aspect of the invention, the lower portion includes six regions: three preferably narrow, substantially planar regions sloping down toward the traction surface interposed by three preferably concavely arcuate, web-like regions, which together preferably form a generally compact triangular footprint, with truncated corners and arcuate sides. The arcuate regions are preferably provided laterally in back portions of the body and at a central forward portion of the body, while the planar regions are provided laterally in a forward portion of the body and at a central back portion of the body.

According to another preferred aspect of the invention, the traction surface preferably includes a circular central region and a plurality of structural branches radiating from the central region. A reinforcing plate is preferably provided in the body between the bore and the traction surface to prevent the end of the cane from inadvertently rupturing the traction surface.

A sleeve is also preferably provided for use between the end of the cane and the bore in the body to accommodate cane ends of varying sizes.

It will be appreciated that when the tip according to the invention is provided on the cane, the cane has a relatively small footprint, yet is self-standing. The shape of the body and the structure of the traction surface create a relatively stable and high traction surface. Moreover, the arcuate lateral back portions of the body are designed to minimize interference of the body of the tip by a foot of an individual using a cane provided with the tip.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
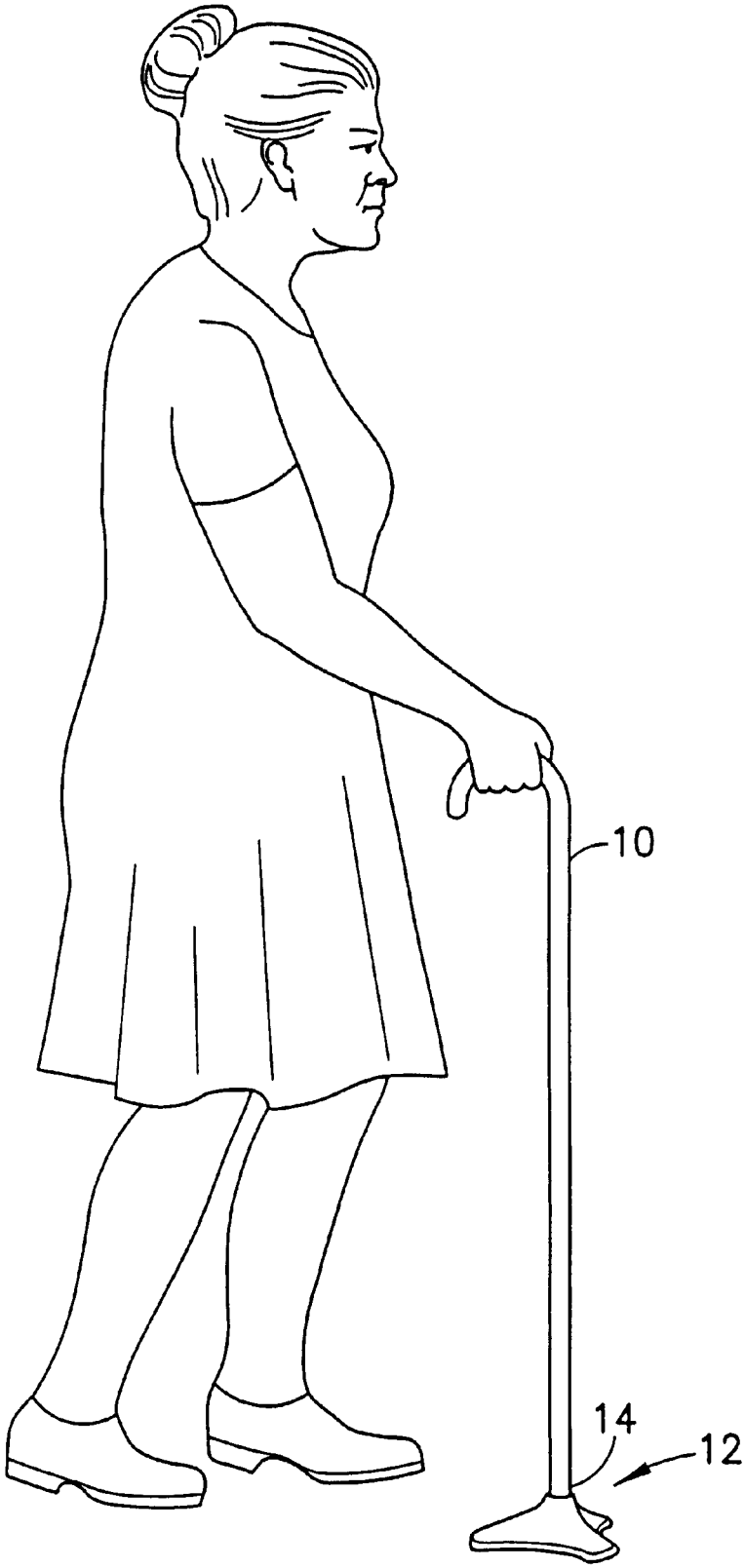
FIG. 1 is an illustration of a cane provided with a cane tip according to the invention in use by an individual.

Turning now to FIG. 1, an individual is shown using a cane 10 provided with a cane tip 12 according to the invention at an end 14 of the cane. Referring to FIGS. 2 through 5, the tip 12 has an elastomeric body 16 which has an upper portion 18 and a lower portion 20 provided with a traction surface 22. The lower portion 20 preferably tapers toward the upper portion 18. The elastomeric body 16 is preferably made from an 80 A to 90 A Durometer material such as Santoprene™, which is available from Advanced Elastomer Systems, L.P. Such a material provides the requisite support for the tip 12 and sufficient flexibility for impact reduction during use.

Figure 2:
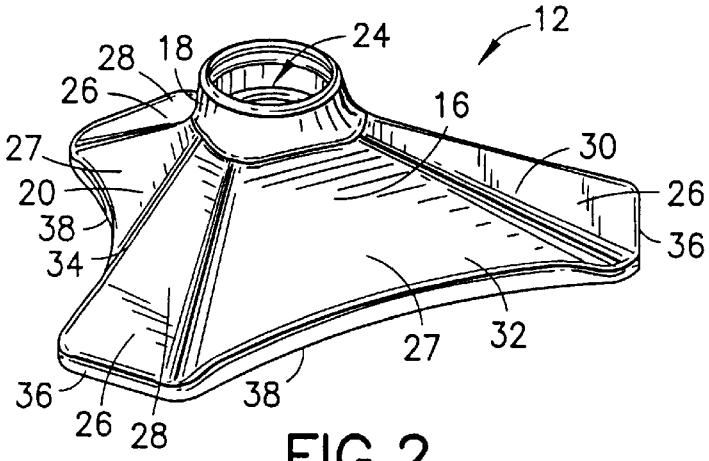
FIG. 2 is a top perspective view of the cane tip according to the invention.
Figure 3:
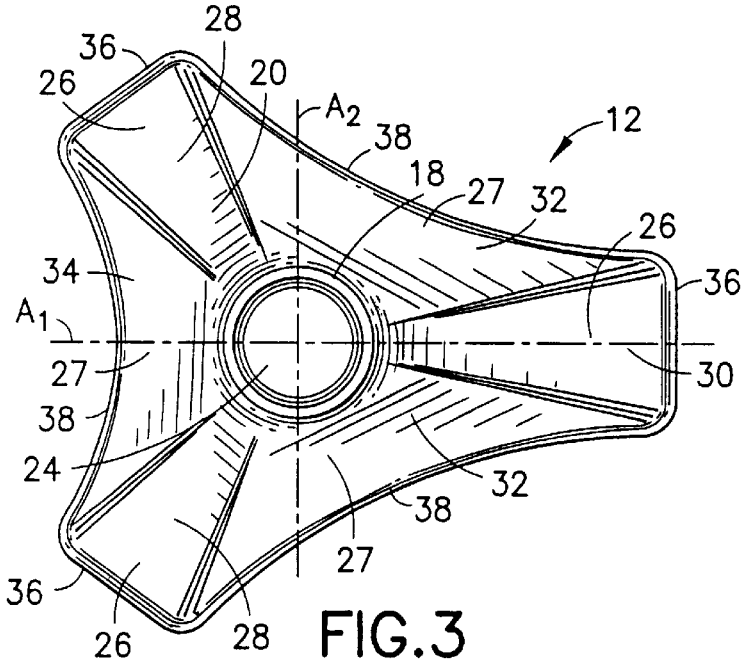
FIG. 3 is a top view of the cane tip according to the invention.
Figure 4:
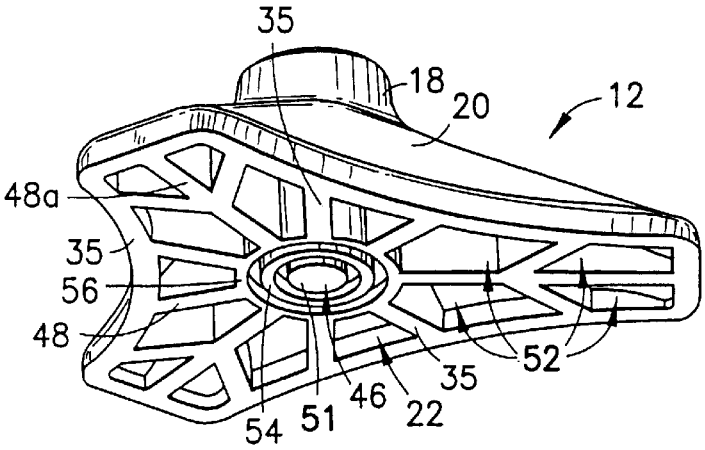
FIG. 4 is a bottom perspective view of the cane tip according to the invention.
Figure 5:
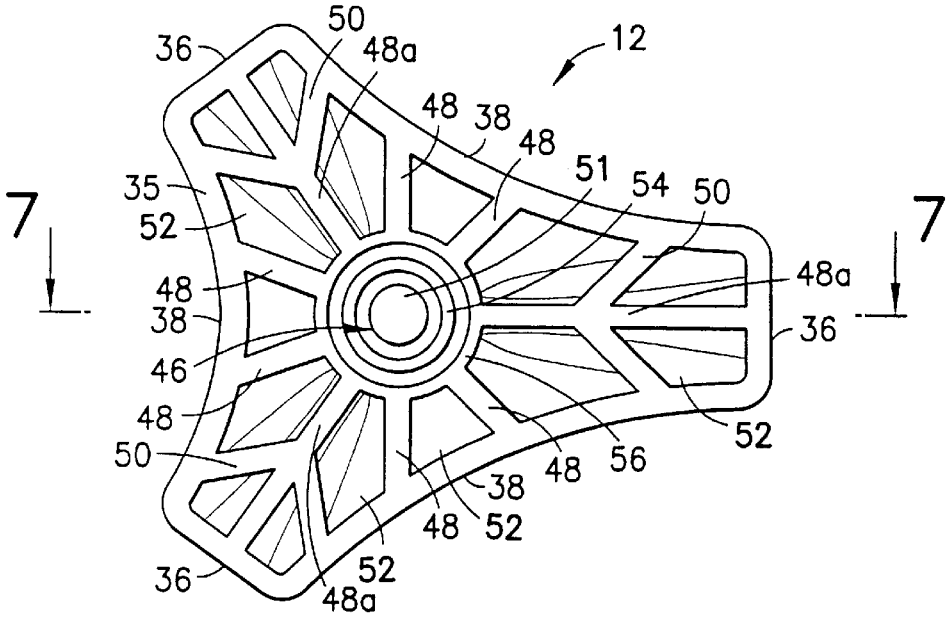
FIG. 5 is a bottom view of the cane tip according to the invention.
Figure 6:
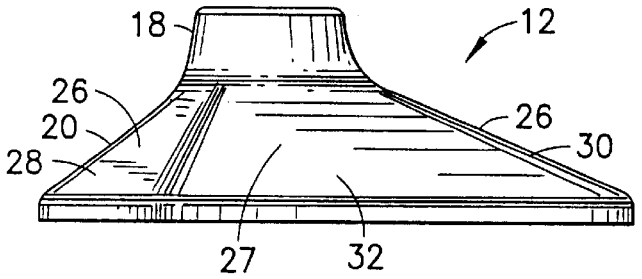
FIG. 6 is a side elevational view of the cane tip according to the invention.
Figure 7:
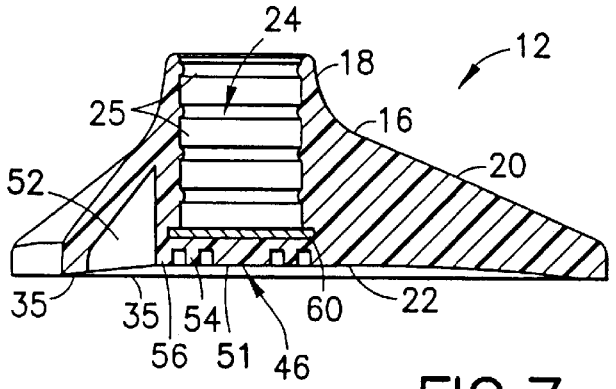
FIG. 7 is a section view across line 7—7 in FIG. 6.

Referring to FIGS. 2, 3 and 7, the body 16 includes a bore 24 which enters through the upper portion 18 of the body and terminates above the traction surface 22 and which receives and holds the lower end 14 of the cane 10. The bore 24 is preferably surrounded by a plurality of elastomeric circumferential ribs (rings) 25. The end 14 of the cane 10 is secured in the tip 12 by forcing the end 14 into the bore such that the elastomeric material surrounding the bore 24 and the ribs 25 frictionally engage the end 14 of the cane. It will be appreciated that the end of the cane may be disengaged from the bore by applying sufficient force.

Turning now to FIGS. 2–4 and 6, the lower portion 20 defines a generally arcuate-sided triangle with truncated corners. More particularly, the lower portion 20 preferably includes six regions: three preferably narrow, substantially planar regions 26 sloping down toward the traction surface 22 interposed by three preferably concavely arcuate, web-like regions 27, which together form a generally compact footprint. The planar regions 26 are provided at lateral forward portions 28 of the body (i.e., directed away from an individual using a cane provided the tip 12) and at a central back portion 30 of the body, while the arcuate regions 27 are preferably provided in lateral back portions 32 of the body 16 and at a central forward portion 34 of the body. As shown in FIGS. 2 and 3, the shapes of the six regions provides a footprint 35 for the tip 12 which preferably has three substantially flat sides 36 and three arcuate sides 38. The central back portion 30 is preferably larger than lateral forward portions 28 to add self-standing stability, as the cane handle when properly aligned extends over and past the central back portion 30. The central back portion 30 may also flex in use to assist walking. The tip thereby has a body which is symmetrical about a first axis $A_1$ extending through the bore and which is asymmetrical about a second axis $A_2$ also extending through the bore at a perpendicular to the first axis.

Referring now to FIGS. 1, 4, 5 and 7, the traction surface 22 is preferably slightly concave within the footprint (periphery of the body) 35 such that when pressure is placed on the body 16 and then released, a vacuum may be formed within the footprint 35 to assist in stabilizing the tip on the ground. Moreover, the concavity of the traction surface 22 is adapted to cushion the impact of the tip 12 of the cane 10 on the ground, and to especially reduce the impact registered on the hand of an individual using a cane provided with the tip. The traction surface 22 includes a tread design preferably including a central region 46 and a plurality of branches 48 radiating from the central region. The central region 46 has a circular portion 51 and a plurality of concentric tread rings 54, 56 about the circular portion. The branches 48 preferably extend to the periphery 35 of the traction surface 22. Preferably nine branches 48 are provided spaced in approximately 40° increments about the central region 46. Preferably a branch 48*a* extends toward each side 36, and each such branch has additional brachiation 50. Voids 52 are preferably provided between the branches 48, 50 and the periphery 35.

Referring to FIG. 7, a weighted reinforcing plate 60, e.g., a metal disc, is preferably provided in the body 16 between the bore 24 and the traction surface 22 to prevent the end of the cane 14 from inadvertently rupturing the traction surface 22.

By way of example, and not by way of limitation, preferred dimensions for the body 16 include approximately four inches in width (from one lateral forward portion 28 to the other lateral forward portion), approximately four inches in length (from the central forward portion 34 to the central back portion 30), and approximately four and a half inches from each lateral forward portion 28 to the central back portion 30. The body portion 16 has a height of approximaltey one and half inches from the lowermost portion of the lower portion 20 to the uppermost portion of the upper portion 18. The tip 16 has a mass of approximately 0.1 kilograms.

Figure 8:
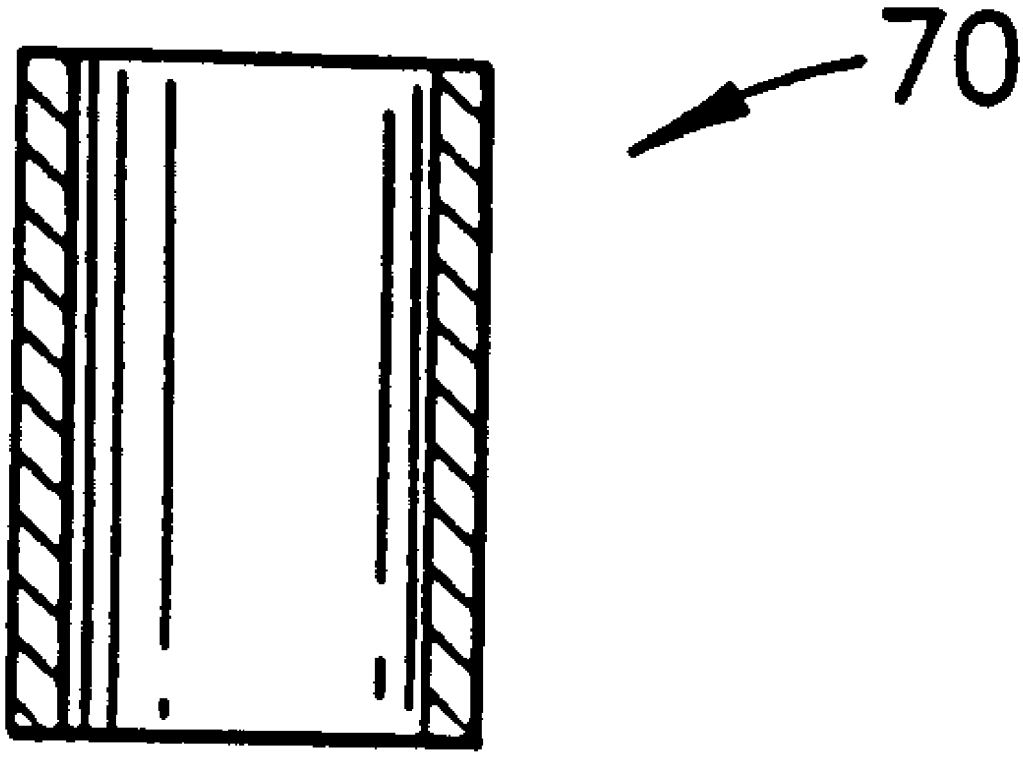
FIG. 8 is a section view of a sleeve for use with the cane tip according to the invention.

Turning now to FIG. 8, a sleeve 70 is also preferably provided for use between the end 14 of a cane and the bore 24 in the body 16. While the bore 24 is preferably sized to permit the most common sizes of cane tips to become engaged therein, the sleeve 70 further accommodates smaller diameter cane ends by effectively increasing the diameter of the ends. The sleeve 70 is provided over the end of the cane, and the cane with sleeve attached is then engaged in the bore.

It will be appreciated that when the tip according to the invention is provided on the cane, the cane has a relatively small footprint, yet is self-standing. The shape of the body and the structure of the traction surface create a relatively stable and high traction surface to the tip. Moreover, the arcuate lateral back portions of the body are designed to further minimize interference of the body of the tip by a foot of an individual using a cane provided with the tip. Furthermore, when an individual uses a cane provided with the tip to support his or her self when rising from a sitting position, the contour of one of the arcuate lateral back portions may be positioned securely against the foot (or shoe) of the individual for additional stability. In addition, should the cane fall over, it will be appreciated that the cane may be righted by carefully placing foot pressure on the one of the truncated corner portions of the tip which is directed upwards when the cane is so oriented, such that the cane slowly rises into a standing position.

There have been described and illustrated herein an embodiment of a tip for a cane. While a particular embodiment of the invention has been described, it is not intended that the invention be limited thereto, as it is intended that the invention be as broad in scope as the art will allow and that the specification be read likewise. Thus, while the body has been described as a unitary elastomeric construct, it will be appreciated that the body may be constructed from more than one component. Furthermore, while a particular tread design has been described which has been shown to provide excellent traction and which also distributes downward pressure placed on the tip over the body, it will be understood that another pattern can alternatively be used. Also, while a plurality of circumferential ribs have been disclosed for engaging an end of a cane in the bore, it will be appreciated that other engagement structure may alternatively or additionally be provided. For example, nubs or vertical ridges may be used. Moreover, while three arcuate sides and three truncated corners have been disclosed about the periphery of the body, it will be appreciated that fewer than three sides may be arcuate, and that the truncated corners while preferably substantially planar may alternatively be curved. In addition, while an 80 A to 90 A Durometer elastomeric material is preferred for the construction of the body, it will be appreciated that materials having other durometers may also be used. Also, while the shape and mass of the body portion have been described as being primarily responsible for the self-standing capability of a cane provided in the tip, it will be appreciated that other means for permitting the cane to be self-standing may be used. For example, a weighted plate may be provided in or on the body portion which alone, or in cooperation with the shape of the body portion, imparts the stability required to provide a cane in the tip with "self-standing" capability. More particularly, the reinforcing plate may be sized and weighted to provide this function. It will therefore be appreciated by those skilled in the art that yet other modifications could be made to the provided invention without deviating from its spirit and scope as so claimed.

What is claimed is:

1. A tip for a cane having a lower end, said tip comprising:

a body portion provided with a bore which receives and holds the lower end of the cane, said body portion having a lower surface having a shape substantially defining a triangle having at least one arcuate side.

2. A tip for a cane according to claim 1, wherein:

said at least one arcuate side is concave.

3. A tip for a cane according to claim 1, wherein:

said triangle has at least one truncated corner.

4. A tip for a cane according to claim 1, wherein:

said body portion includes at least one elastomeric ring about said bore, said at least one elastomeric ring for frictionally engaging the end of the cane.

5. A tip for a cane according to claim 1, wherein:

said body portion includes a plurality of axially spaced-apart elastomeric rings about said bore, said plurality of elastomeric rings permitting a range of differently diametered cane ends to be frictionally engaged in said bore.

6. A tip for a cane according to claim 1, wherein:

said lower surface has a tread design which includes a plurality of concentric treads.

7. A tip for a cane according to claim 1, wherein:

said lower surface has a tread design provided with at least one tread which extends from a central region of said tread design to a peripheral portion of said tread design.

8. A tip for a cane according to claim 1, further comprising:

a means for permitting the cane to be self-standing.

9. A tip for a cane according to claim 8, wherein:

said means for permitting the cane to be self-standing includes a central back portion of said body portion.

10. A tip for a cane according to claim 1, wherein:

a means for structurally strengthening said body portion is provided in said body portion between said bore and said lower surface.

11. A tip for a cane according to claim 1, wherein:

said body portion is comprised of a molded elastomeric substance.

12. A tip for a cane according to claim 1, further comprising:

an elastomeric sleeve positionable between the lower end of the cane and said body portion surrounding said bore.

13. A tip for a cane having a lower end, said tip comprising:

a body portion having a lower surface having a shape defined by a triangle with at least one truncated corner and at least two concavely arcuate sides, and a bore which receives and holds the lower end of the cane.

14. A tip for a cane according to claim 13, further comprising:

a means for permitting the cane to be self-standing wherein said at least one truncated corner comprises three truncated corners, and said means for permitting the cane to be self-standing includes at least one of said three truncated corners.

15. A cane, comprising:

a) an elongate shaft having a handle and a lower end opposite said handle; and b) a body portion provided with a bore which receives and holds said lower end of said shaft, said body portion having a lower surface having a shape substantially defining a triangle having at least one arcuate side.

16. A cane according to claim 15, wherein:

said at least one arcuate side is concave.

17. A cane according to claim 15, wherein:

said triangle has at least one truncated corner.

18. A cane according to claim 15, wherein:

said body portion includes at least one elastomeric ring about said bore, said at least one elastomeric ring frictionally engaging the end of the cane.

19. A cane according to claim 15, wherein:

said body portion includes a plurality of axially spaced-apart elastomeric rings about said bore, said plurality of elastomeric rings permitting a range of differently diametered cane ends to be frictionally engaged in said bore.

20. A cane according to claim 15, wherein:

said lower surface has a tread design which includes a plurality of concentric treads.

21. A cane according to claim 15, wherein:

said lower surface has a tread design provided with at least one tread which extends from a central region of said tread design to a peripheral portion of said tread design.

22. A cane according to claim 15, further comprising:

a means for permitting the cane to be self-standing.

23. A tip for a cane according to claim 22, wherein:

said means for permitting the cane to be self-standing includes a central back portion of said body portion.

24. A tip for a cane according to claim 15, wherein:

a means for structurally strengthening said body portion is provided in said body portion between said bore and said lower surface.

25. A tip for a cane according to claim 15, wherein:

said body portion is comprised of a molded elastomeric substance.

26. A cane, comprising:

a) an elongate shaft having a handle and a lower end opposite said handle; and b) a body portion having a lower surface provided with a shape defined by a triangle with at least one truncated corner and at least two concavely arcuate sides, and a bore which receives and holds said lower end of said shaft.

27. A cane according to claim 26, wherein:

said body portion includes a means for permitting the cane to be self-standing, wherein said at least one truncated corner comprises three truncated corners, and said means for permitting the cane to be self-standing includes at least one of said three truncated corners.

28. A cane for assisting an individual to stand or walk on a ground surface, comprising:

a) an elongate shaft having a handle and a lower end opposite said handle; and b) a body portion having an upper portion provided with a bore which receives and holds said lower end of said shaft and a lower portion having a substantially flat or concave lower-most surface larger than said upper portion, said body portion causing said cane to be self-standing when said lower-most surface is placed on and contacts the ground surface.

29. A cane according to claim 28, wherein:

said body portion is comprised of an elastomeric material.

30. A cane according to claim 29, wherein:

said elastomeric material has a Durometer of approximately 80 A to 90 A.

31. A tip for a cane having a lower end, said tip comprising:

a body portion having a lower base portion which is substantially planar or concave, an upper portion provided with a bore which receives and holds the lower end of the cane, and means for permitting the cane to be self-standing, said body portion having a shape defined by a first axis extending perpendicular to and through said bore about which said body portion is symmetrical, said body portion being asymmetrical along all other axes extending perpendicular to and through said bore.

32. A tip for a cane having a lower end, said tip comprising:

a body portion provided with a bore which receives and holds the lower end of the cane, said body portion defining a lower surface having at least one arcuate side and exactly three corners.

33. A tip for a cane having a lower end, said tip comprising:

a body portion provided with a bore which receives and holds the lower end of the cane, said body portion defining a lower surface having at least two arcuate sides and exactly three corners.

34. A tip for a cane having a lower end, said tip comprising:

a body portion provided with a bore which receives and holds the lower end of the cane, said body portion defining a lower surface having three sides and exactly three truncated corners.

* * * * *